United States Patent [19]

Eisenhoffer

[11] 4,262,189

[45] Apr. 14, 1981

[54] INSULATED JACKET FOR HEAT PRESS MACHINES

[76] Inventor: Joseph T. Eisenhoffer, 5601 Rhodes, St. Louis, Mo. 63109

[21] Appl. No.: 13,211

[22] Filed: Feb. 21, 1979

[51] Int. Cl.[3] ..... D06F 75/08

[52] U.S. Cl. ..... 219/245; 219/524; 220/444; 165/154; 150/52 R; 206/545

[58] Field of Search ..... 219/211, 212, 243, 245, 219/246, 247, 385, 386, 387, 521, 524, 528, 525, 527; 220/444; 165/154; 206/545; 312/214, 284; 150/52 R

[56] References Cited

U.S. PATENT DOCUMENTS

| | | | |
|---|---|---|---|
| 1,958,592 | 5/1934 | Ruelland | 219/245 |
| 2,013,854 | 9/1935 | Ruelland | 219/245 |
| 2,363,735 | 11/1944 | Lord | 219/527 |
| 2,881,299 | 4/1959 | Jepson | 219/524 X |
| 3,353,886 | 11/1967 | Tompkins | 206/545 X |
| 3,527,925 | 9/1970 | Toyooka et al. | 219/521 |
| 3,799,386 | 3/1974 | Mandalin et al. | 220/444 X |
| 3,879,171 | 4/1975 | Tulis | 219/527 X |
| 4,071,065 | 1/1978 | Halbich | 150/52 R |
| 4,163,896 | 8/1979 | McArvin et al. | 219/525 |

*Primary Examiner*—Volodymyr Y. Mayewsky
*Attorney, Agent, or Firm*—Cohn, Powell & Hind

[57] ABSTRACT

The insulation jacket is intended to be fitted over the heater platen of a heat transfer machine such as a machine used for impressing insignia on clothing articles. The jacket includes upper and lower walls, side walls and a rear wall of insulation material connected to form an open-ended box receivable by the heater platen. The interior of the box is provided with a foil lining and the exterior is provided with a fabric sheath. The upper wall includes a cut-out portion to avoid machine elements projecting above the heater platen.

5 Claims, 5 Drawing Figures

INSULATED JACKET FOR HEAT PRESS MACHINES

BACKGROUND OF THE INVENTION

This invention relates generally to heat press machines and particularly to an insulation system for use with such machines.

Heat press machines of the type under consideration such as heat lettering machines are subject to a number of problems resulting from the heat generated by the heater platen. Heat problems are aggravated because the machines are frequently maintained in an "on" condition, even though pressing time may amount to less than twenty seconds, because of the considerable time required for warm up.

One of the primary problems associated with excess heat is, of course, operator comfort. The operator is of necessity working in close proximity to the heater platen and this is particularly true during the time that the transfer insignia is being arranged on the article to be processed.

Another problem results from the fact that radiated heat tends to warm up the working enviroment considerably, so that it becomes desirable to cool down the working area, which can be a considerable air conditioning expense. In addition, there is also the related problem of heat loss from the machine particularly during the relatively long period between pressings.

Yet another problem resides in the fact that the base platen is relatively close to the heater platen because this results in the base platen being radiated with heat from the heater platen. This causes problems when certain types of insignia are used because the transfer material tends to curl and is difficult to arrange properly. In fact, in some instance it is necessary to shut the machine off until the base platen cools sufficiently to permit this type of transfer to be pressed.

These and other problems are solved by the insulation system of the present invention in a manner not disclosed in the known prior art.

SUMMARY OF THE INVENTION

When this insulation system is provided for a heat press machine it shields the operator from direct contact with the underside of the heater platen during the setting up the article to be processed. Further, by reducing radiated heat in the working enviroment of the operator expense in air conditioning this enviroment is minimized. It also saves on machine heating cost by reducing heat loss from the machine.

This insulation system is for use with machines such as heat lettering machines having a heater platen which is disposed above a base platen and is movable into engagement with an article disposed on the base platen. The system provides an insulation member including a wall of insulation material disposed below the heater platen adjacent the heat face thereof and provides means for removably attaching said member to the heater platen.

The insulation system includes a removable jacket for the heater platen including a lower wall, an upper wall, a pair of side walls connecting said upper and lower walls and a rear wall connecting said upper and lower walls, all of said walls cooperating to define an open-ended box removably receivable by the heater platen.

According to one aspect of the invention the insulated walls are formed of fiberglass material, each insulated wall including a reinforced foil skin on one face forming an interior lining for the jacket.

In another aspect of the invention the jacket includes an outer fabric sheath substantially covering the exterior thereof.

In a further aspect of the invention the upper, lower and side walls include forward, end faces defining the open box end and insulation tape is provided to bind said forward end faces, said tape extending between the interior lining and the exterior sheath.

In yet another aspect of the invention the lining of the upper wall is provided with runner strips engagable with relatively small projecting elements of the heater platen as the jacket is received by the heater platen to prevent damage to the interior lining.

According to another aspect of the invention the upper wall of the jacket includes a cut-out or cut back portion formed to avoid relatively large projecting elements on the upper surface of the heater platen.

DESCRIPTION OF THE PREFERRED EMBODIMENT

Figure 1:
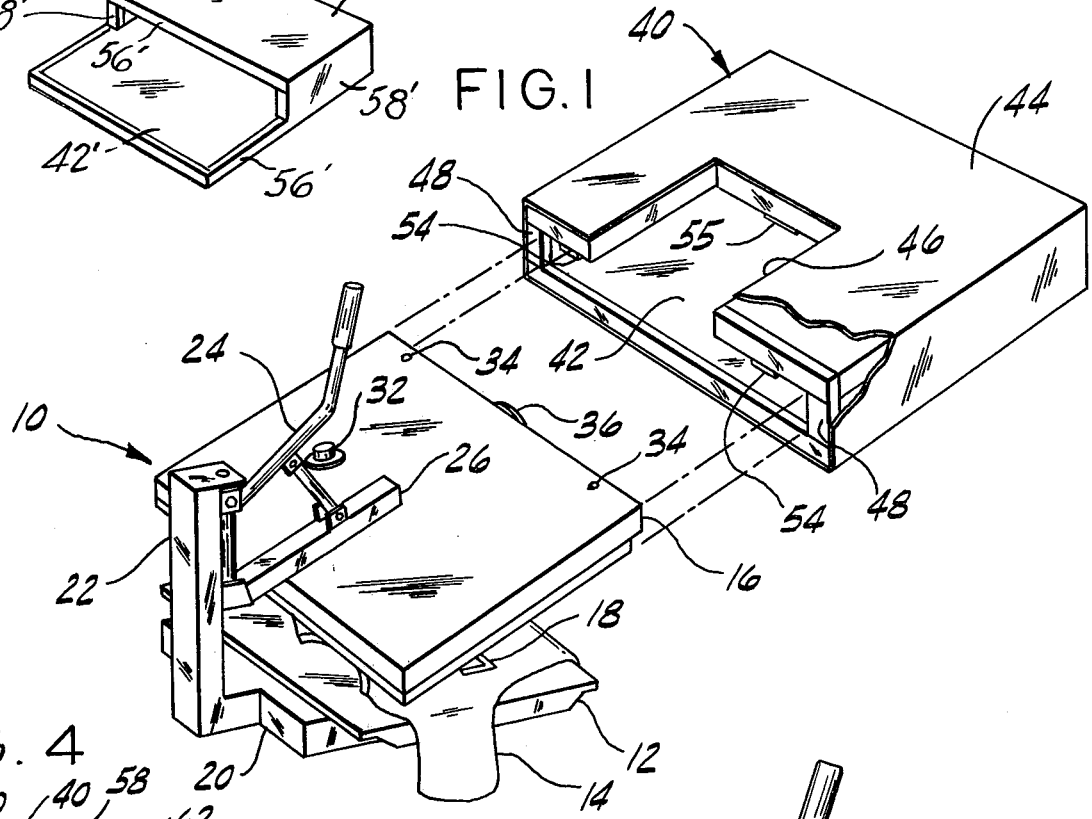
FIG. 1 is a perspective view of a heat lettering machine showing the insulation jacket removed.

Referring now by reference numerals to the drawing and first to FIG. 1 it will be understood that the heat lettering machine indicated by 10 is of the type having a lower, base platen 12, which provides a resilient receiving surface 15 for an article of clothing such as a tee-shirt 14, and an upper, heater platen 16. The heater platen 16 is movable toward and into engagement with the tee-shirt 14 for the purpose of heat-impressing a transfer insignia, indicated by 18, onto said shirt.

In the embodiment shown, the machine 10 includes a support structure 20 which carries the base platen 12 and includes a post 22, which provides a mounting for a linkage assembly 24 carrying the heating platen 16. As shown, the linkage assembly 24 includes a lower member 26 connected to the heater platen 16, and a handle 28 connected to said lower member 26 by means of a link 30. As will be readily understood, the heater platen 16 is is pivotable downwardly, by the handle 28, toward engagement with the base platen 12.

A removable insulation member, in the form of a jacket, indicated by numeral 40, is provided for the upper heater platen 16. This jacket 40 is structurally configurated to overfit the platen 16, and can be readily removed by the operator, prior to moving said platen into engagement with the shirt 14, by simply slidingly withdrawing it rearwardly.

Figure 2:
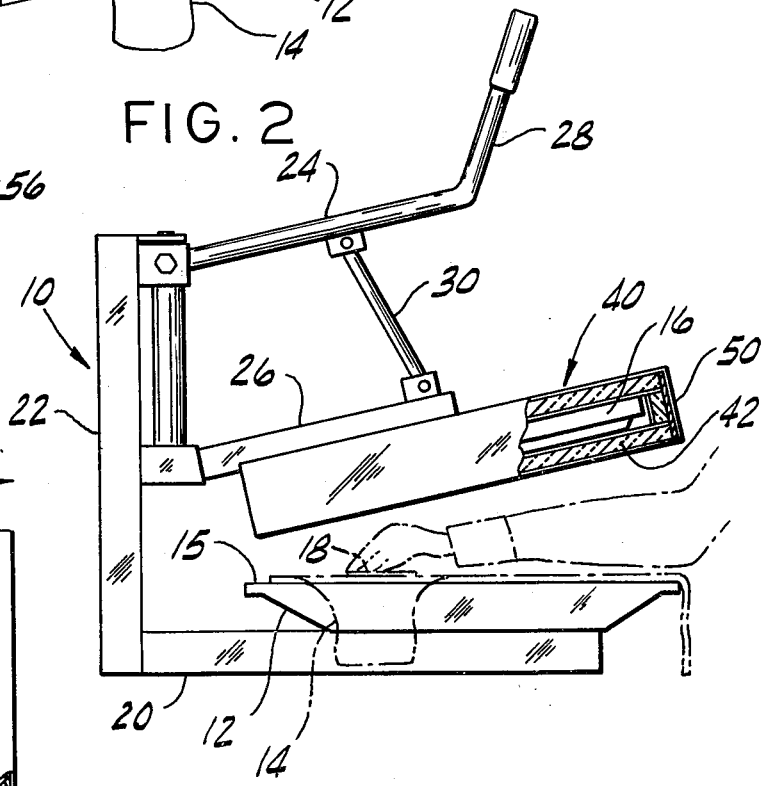
FIG. 2 is a side elevational view of the heat lettering machine showing the insulation jacket in position.
Figure 3:
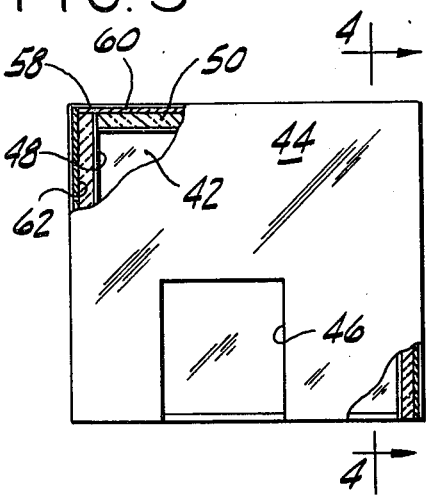
FIG. 3 is a plan view of the insulation jacket.

In the embodiment shown, the jacket 40 is constructed from fiberglass board material formed into an open-ended box. As shown by reference 16 FIGS. 1–3, the jacket 40 includes a lower wall 42 disposed adjacent the lower face of the heater platen 16 and an upper wall 44 having a cut-out portion 46 for clearing relatively large projections on the upper face of the heater platen 16, such as the switch 32 and the link assembly lower member 26. Side walls 48 are provided extending between and connecting the upper and lower walls 42 and 44 and a rear end wall 50 is provided extending between and connecting said upper and lower walls and said side walls. In the embodiment shown silicone rubber adhesive such as GE (General Electric) 1200 is used as the connecting medium. In effect, the upper wall 44 and side walls 48 provide a means of holding the lower wall 42 in place adjacent said heater platen.

Figure 4:
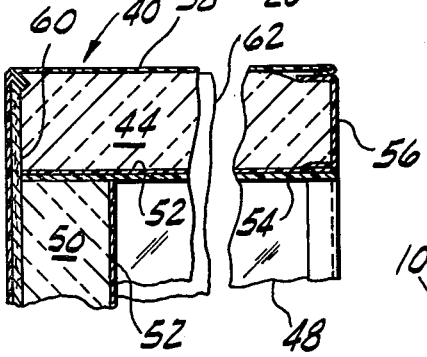
FIG. 4 is an enlarged, fragmentary cross sectional view taken on line 4—4 of FIG. 3.

The fiberglass material forming the jacket walls is provided on one side with a reinforced metallic foil skin. In the preferred embodiment the material in No. 3 density Fiberglass board with a Skrimcraft foil face. This skin, indicated in FIG. 4, provides the jacket 40 with an interior lining 52. In order to prevent damage to the lining 52 from minor projections such as screw heads 34 and the upper portion of a gauge indicated by 36, the lining 52 is provided with reinforcing strips of heat resistant insulation tape 54 of nylon or the like which engage the screw heads 34 and gauge 36 as jacket 40 is installed in place. In the preferred embodiment the front end faces of the jacket upper, lower and side walls 42, 44 and 48 are also provided with protective adhesive heat resistant insulation tape in the form of a binding indicated by numeral 56. As shown in FIG. 4 this binding 56 is formed into a channel configuration and laps the exterior and interior margins of the wall end faces.

The jacket 40 includes an outer covering of vinyl, or similar material, in the form of a sheath 58 which provides a complete exterior covering for the otherwise exposed fiber glass insulation material of the walls and provides substantial assistance in holding the walls together. The sheath 58 is hemmed around the front edges as shown in FIG. 4 and is attached to the taped binding as by silicone rubber adhesive. As also shown in FIG. 4 the sheath 58 is provided with stiffener elements 60 and 62 of cardboard, or the like, disposed adjacent the rear end wall and the side walls respectively to assist in maintaining the shape of jacket 40.

Figure 5:
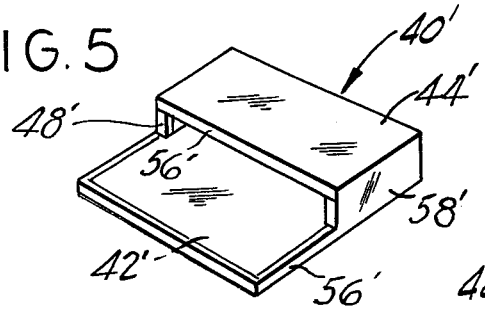
FIG. 5 is a reduced perspective view of a modified jacket.

A modified insulation jacket is shown in FIG. 5. This jacket is similar to that already described above with respect to the details and for this reason like parts are given the same reference numeral with the addition of a prime notation. In the modified jacket 40' the upper and side walls 44' and 48' are terminated short of the lower wall 42' to facilitate the avoidance of relatively large projections that occur on some lettering machines (not shown). The sheath 58' is coterminous with the upper and side walls but extends the full length of the lower wall. It will be readily understood that the otherwise exposed edges of the lower wall 42' are provided with taped binding 58' including the side edges. It will also be understood that runner strips (not shown) can also be provided where necessary to protect the interior lining.

It is thought that the structural features and functional advantages of this insulation jacket have become fully apparent from the foregoing description of parts. However, for completeness of disclosure the use of the jacket in conjunction with the heat lettering machine will be briefly discussed with reference to FIG. 1.

The actual pressing operation typically takes no more than twenty seconds and the jacket 40 is kept on the heater platen 16 at all times except during the pressing operation. Thus, the operator can arrange clothing article, such as the shirt 14 on the resilient pad 15 of the lower platen 12 and also place the insignia in the desired location. Following this, the operator grasps the vinyl side of the jacket 40 which are preferrably texture to provide a better grip, and, because the jacket is a relatively loose fit the operator can easily slide the jacket 40 rearwardly off the heater platen 16. The jacket 40 then can be placed in a temporary storage position and the upper heater platen drawn down into engagement with the shirt 14 by the handle 28. After the pressing operation the insulation jacket 40 is replaced on the machine and maintained in place until the next pressing operation. Because of the upper wall cut-out 46 the temperature control switch 28 is readily accessible and the machine can therefore be heat adjusted, and turned on and off with the jacket in position.

I claim as my invention:

1. In an improved heat lettering machine of the class wherein a heater platen having a heat face is disposed above a base platen and is movable into engagement with an article disposed on said base platen, wherein the improvement comprises:

(a) a removable jacket for the heater platen, the jacket having:
  1. a lower wall of insulation material disposed below the heater platen adjacent the heat face,
  2. an upper wall of insulation material disposed above said heater platen,
  3. a pair of side walls of insulation material extending between said upper and lower walls,
  4. a rear wall of insulation material extending between said upper and lower walls, and
  5. means connecting said upper, lower, side and rear walls to form an open-ended box removably receivable by said heater platen.

2. In an improved heat lettering machine of the class wherein a heater platen having a heat face is disposed above a base platen and is movable into engagement with an article disposed on said base platen, wherein the improvement comprises:

(a) a removable jacket for the heater platen, the jacket having:
  1. a lower wall of insulation material disposed below the heater platen adjacent the heat face,
  2. an upper wall of insulation material disposed above said heater platen,
  3. a pair of side walls of insulation material extending between said upper and lower walls,
  4. a rear wall of insulation material extending between said upper and lower walls, and
  5. means connecting said upper, lower, side and rear walls to form an open-ending box removably receivable by said heater platen, (b) each of said insulation walls including metal foil material on the inner face forming an interior lining for the box.

3. In an improved heat lettering machine of the class wherein a heater platen having a heat face is disposed above a base platen and is movable into engagement with an article disposed on said base platen, wherein the improvement comprises:

(a) a removable jacket for the heater platen, the jacket having:
  1. a lower wall of insulation material disposed below the heater platen adjacent the heat face,
  2. an upper wall of insulation material disposed above said heater platen,
  3. a pair of side walls of insulation material extending between said upper and lower walls,
  4. a rear wall of insulation material extending between said upper and lower walls, and 5. means connecting said upper, lower, side and rear walls to form an open-ended box removable receivable by said heater platen, (b) each of the insulation walls including a covering material on the outer face forming an exterior sheath.

4. In an improved heat lettering machine of the class wherein a heater platen having a heat face is disposed above a base platen and is movable into engagement with an article disposed on said base platen, wherein the improvement comprises:

(a) a removable jacket for the heater platen, the jacket having:

1. a lower wall of insulation material disposed below the heater platen adjacent the heat face,
2. an upper wall of insulation material disposed above said heater platen,
3. a pair of side walls of insulation material extending between said upper and lower walls,
4. a rear wall of insulation material extending between said upper and lower walls, and
5. means connecting said upper, lower, side and rear walls to form an open-ended box removably receivable by said heat heater platen, (b) each of said insulation walls including metal foil material on the inner face forming an interior lining for the box, (c) each of the insulation walls including a covering material on the outer face forming an exterior sheath, (d) said upper, lower and side walls including forward and end faces defining the open end, and (e) insulating tape binding is provided for said forward end faces extending between said foil lining and said exterior sheath.

5. In an improved heat lettering machine of the class wherein a heater platen having a heat face is disposed above a base platen and is movable into engagement with an article disposed on said base platen, wherein the improvement comprises:

(a) a slidingly removable jacket for the heater platen, the jacket having:

1. a lower wall of insulation material disposed below the heater platen adjacent the heat face,
2. an upper wall of insulation material disposed above said heater platen,
3. a pair of side walls of insulation material extending between said upper and lower walls,
4. a rear wall of insulation material extending between said upper and lower walls,
5. means connecting said upper, lower, side and rear walls to form an open-ended box removably receivable by said heater platen, and
6. means providing an interior lining disposed adjacent the heat face.

* * * * *